United States Patent [19]

Correnti et al.

[11] Patent Number: 4,566,726

[45] Date of Patent: Jan. 28, 1986

[54] METHOD AND APPARATUS FOR HANDLING SEMICONDUCTOR WAFERS

[75] Inventors: Albert D. Correnti, Hamilton Township, Mercer County; James Potechin, Cranbury, both of N.J.

[73] Assignee: AT&T Technologies, Inc., Berkeley Heights, N.J.

[21] Appl. No.: 620,247

[22] Filed: Jun. 13, 1984

[51] Int. Cl.[4] ..... B66C 1/02

[52] U.S. Cl. ..... 294/64.3; 414/737; 414/752; 414/744 B

[58] Field of Search ..... 294/64 R, 64 A, 64 B, 294/1 CA, 65; 226/97; 271/97, 98, 195; 414/737, 744 B, 752

[56] References Cited

U.S. PATENT DOCUMENTS

| | | | |
|---|---|---|---|
| 3,220,723 | 11/1965 | Rabinow | 294/64.1 |
| 3,431,009 | 3/1969 | Mammel | 294/64 |
| 3,523,706 | 8/1970 | Logue | 294/64 |
| 3,721,472 | 3/1973 | Mammel | 302/31 |
| 3,918,593 | 11/1975 | Kaufeldt | 214/1 BH |
| 4,009,785 | 3/1977 | Trayes | 214/1 BT |
| 4,185,814 | 1/1980 | Buchmann et al. | 271/108 |
| 4,257,637 | 3/1981 | Hassan et al. | 294/64 |

*Primary Examiner*—James B. Marbert

*Attorney, Agent, or Firm*—M. M. de Picciotto; R. B. Levy

[57] ABSTRACT

A semiconductor wafer pickup device (26) making use of vacuum and Bernoulli effect in order to hold the wafer (11) against the device and to minimize wafer contamination. The wafer pickup device comprises a centrally located Bernoulli orifice (32) and a plurality of peripherally located small tubular legs (38,39,40). In a first stage of a pickup operation, air is blown out of the Bernoulli orifice and out of the tubular legs. Next, vacuum is applied to the tubular legs while pressurized air is still blown out of the Bernoulli orifice. The combination of the Bernoulli effect with the suction at the vacuum legs locates the wafer in a position where the legs hold onto it. Then, the pressurized air is turned off thus leaving the wafer held only by the vacuum legs (FIGS. 2A, 2B).

10 Claims, 4 Drawing Figures

METHOD AND APPARATUS FOR HANDLING SEMICONDUCTOR WAFERS

TECHNICAL FIELD

The present invention relates to automated techniques for handling semiconductor wafers, and more particularly, to a method and an apparatus for picking up semiconductor wafers on an automatic basis without damaging them.

BACKGROUND OF THE INVENTION

In the processing of semiconductor devices, such as transistors, diodes and integrated circuits, a plurality of semiconductor devices are fabricated simultaneously on a thin slice of semiconductor material called semiconductor wafer. Such a semiconductor wafer is extremely brittle and easily contaminated. Thus, in the manufacturing of semiconductor integrated circuits, care should be taken to avoid physical damage and contamination to the semiconductor wafers.

Various known techniques enable the handling of wafers without human intervention. One known wafer handling device makes use of vacuum to hold the wafer in intimate contact with a pickup surface of the device. Such an intimate contact may result in possible damage to, and contamination of, the wafer.

Another known wafer pickup device is described in U.S. Pat. No. 3,341,009 issued on Mar. 4, 1969 to W. K. Mammel and assigned to the assignee herein. In such known pickup device, a semiconductor wafer is supported on a layer of fluid thus avoiding the above-discussed disadvantages of the intimate contact between a surface of the wafer and the surface of the pickup device. Although the device disclosed by W. K. Mammel operates satisfactorily for its intended purposes, retaining pins attached to the device and located around the peripheral edge of the wafer are required to limit the random lateral shifting of the wafer relative to the pickup surface. Any resulting frequent impacts of the edge portion of the wafer against the pins may cause the generation of particles leading to physical damage, contamination, and ultimately low yield of the integrated circuits produced. Furthermore, the retaining pins, outwardly protruding around the edge of the wafer, prevent such known device from reaching into a wafer cassette between adjacent wafers and picking up a predetermined wafer.

Therefore, there exists a need for a technique for handling semiconductor wafers while substantially minimizing the deleterious effects of wafer contamination, and enabling the loading/unloading of wafers into/out of wafer cassettes.

SUMMARY OF THE INVENTION

The foregoing need is met in an illustrative embodiment of the invention wherein a wafer pickup device for handling a semiconductor wafer comprises means for lifting and supporting the semiconductor wafer on a flow of pressurized fluid utilizing the Bernoulli effect; means for gently contacting a plurality of predetermined portions of the wafer by means of vacuum; and means for interrupting the flow of pressurized fluid and holding the wafer only at its predetermined portions by means of vacuum.

In accordance with a specific embodiment of the invention, the wafer pickup device comprises a substantially planar pickup surface having a substantially centrally located orifice formed therein; a plurality of tubular bodies extending away from the pickup surface and located proximate to and within the outer boundaries of the pickup surface; first means coupled to the orifice and to the tubular bodies for selectively applying pressurized fluid therethrough for lifting a semiconductor wafer toward and in spaced relationship to the pickup surface; and second means coupled to the tubular bodies for selectively applying vacuum therethrough thereby holding the semiconductor wafer to be handled against the tubular bodies.

In accordance with another embodiment of the invention, a method for handling a semiconductor wafer by means of a pickup device comprises the steps of lifting and supporting, by means of a flow of pressurized fluid, a semiconductor wafer utilizing the Bernoulli effect; applying vacuum to a plurality of tubular bodies extending away from the pickup device thereby raising the wafer in the direction of the pickup device; and interrupting the flow of the Bernoulli effect pressurized fluid thereby holding the wafer against the pickup device only by means of vacuum.

A preferred embodiment of the foregoing method comprises the sequentially steps of positioning a planar pickup surface of the pickup device proximate to a major surface of the wafer; supplying a first flow of pressurized fluid through a centrally located orifice of the pickup surface toward the major surface for lifting the wafer utilizing the Bernoulli effect; supplying a plurality of second flows of pressurized fluid directed toward the major surface of the wafer through a plurality of tubular bodies extending away from the pickup surface; interrupting the second flows of pressurized fluid and applying vacuum to the tubular bodies thereby gently contacting peripheral portions of the major surface of the wafer; and interrupting the first flow of pressurized fluid thereby holding the wafer against the tubular bodies by means of the vacuum applied thereto.

DETAILED DESCRIPTION

Figure 1:
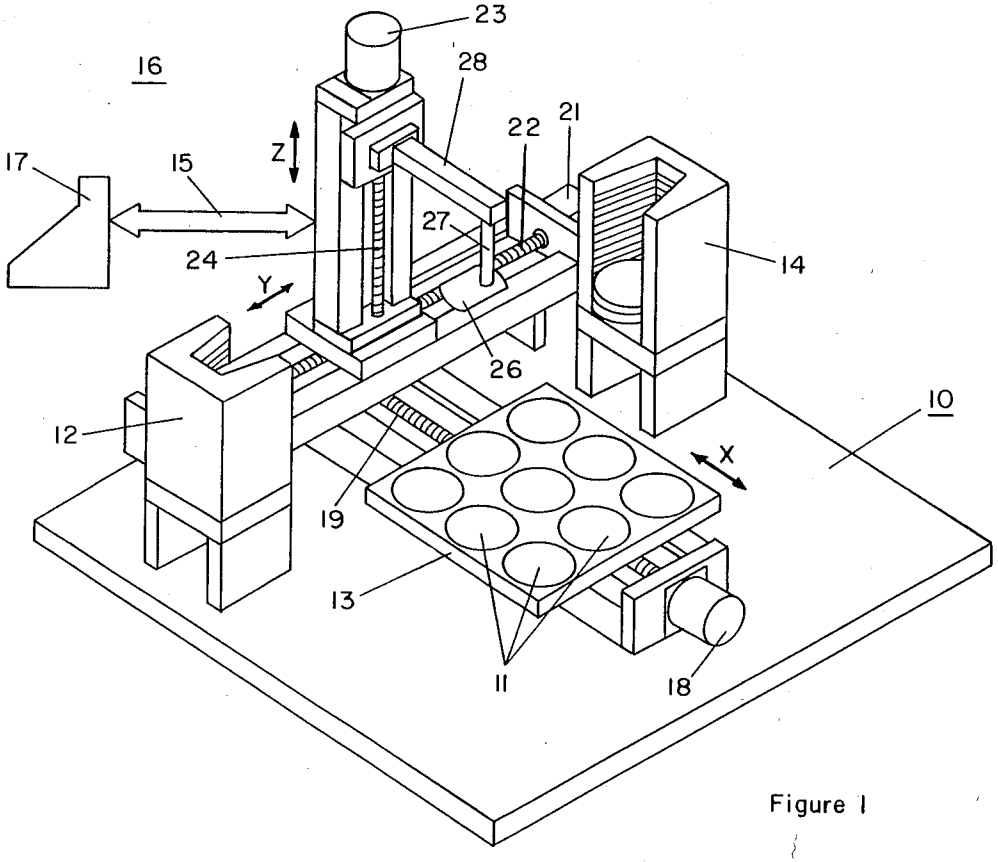
FIG. 1 is a perspective view of a wafer handling system making use of a wafer pickup device in accordance with an embodiment of the invention.

Shown in FIG. 1 is a semiconductor wafer handling system 10 capable of unloading a plurality of wafers 11 from an input cassette 12 and loading them onto a process wafer carrier plate 13. Subsequent to a series of wafer processing steps, the wafers 11 are unloaded from the process wafer carrier plate 13 and placed in an output cassette 14 of processed wafers. Typically, the cassettes 12 and 14 would hold about twenty-five of the wafers 11 in individual pockets. Commercially available cassettes of the type described above are manufactured and sold by the FLUOROWARE® Corporation of Chaska, Minn. under various model numbers.

The wafer handling systems 10 comprises a robotic manipulator 16 operating under a computer controller 17 via a bidirectional control bus 15. The robotic manipulator 16, schematically shown in FIG. 1 is of a type having two orthogonal axes of movement Y and Z. However, other types of robotic manipulators may be used without departing from the spirit and scope of the present invention. The process wafer carrier plate 13 is selectively movable along a horizontal direction, X, by means, for example, of a moving mechanism including a motor 18 and a lead screw 19 coupled thereto. Such an arrangement results in a robotic manipulator 16 capable of reaching a plurality of positions of desired Cartesian coordinates X, Y and Z. The mechanism for selectively moving the carrier plate 13 along the horizontal direction, X, may comprise any arrangement capable of accurately transporting the carrier plate 13 between several positions along the horizontal direction, X. Such other moving arrangement may include other mechanism capable of transforming a rotation movement to a translation movement, or may include a linear translation mechanism such as a bidirectional stepping motor having its reciprocating axle secured to the carrier plate 13. Similarly, the movements of the robotic manipulator 16 along the other two axes Y and Z, may be achieved by means of two motor driven moving mechanisms 21, 22 and 23, 24, respectively, each mechanism including any one of the just described arrangements.

A wafer pickup device 26, coupled to an L-shaped support member 27, 28 of the robotic manipulator 16, is used to unload a wafer out of the input cassette 12, place it on the wafer carrier plate 13, and subsequently lift out of the carrier plate 13 and load it into the output cassette 14. As shown in FIG. 1, nine wafers 11 are loaded on the wafer carrier plate 13 in a $3\times3$ array. Such a loaded carrier plate 13 may subsequently be inserted in a gold plating machine, for example, for further processing of the top surfaces of the wafers 11. The shape of the carrier plate 13 complicates the handling of the wafers 11 because it provides access only to the exposed top surfaces thereof. Prior art handling arrangements hold the wafers from their bottom surfaces by means of vacuum pickups. However, it is more difficult to use vacuum from the top side of the wafer because of the difficulties in making contact with the vacuum source without crushing or damaging the top surface of the wafer.

Figure 2A:
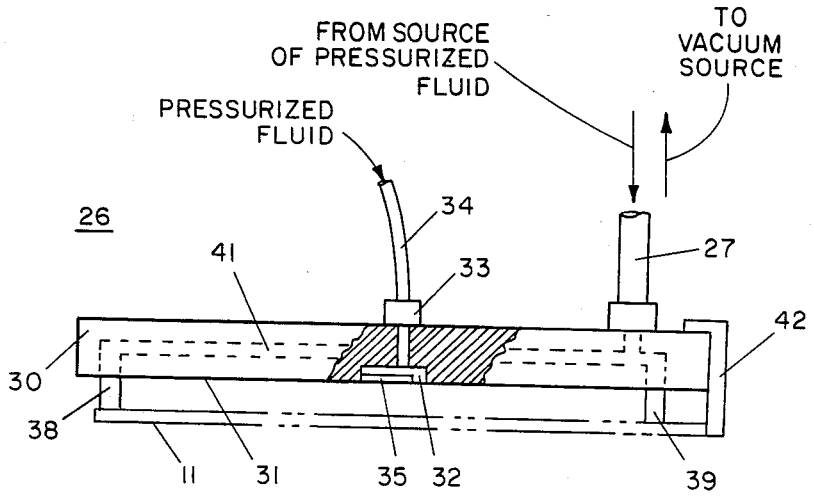
FIGS. 2A and 2B, respectively, show a side view and a bottom view of the wafer pickup device in accordance with an embodiment of the invention.
Figure 2B:
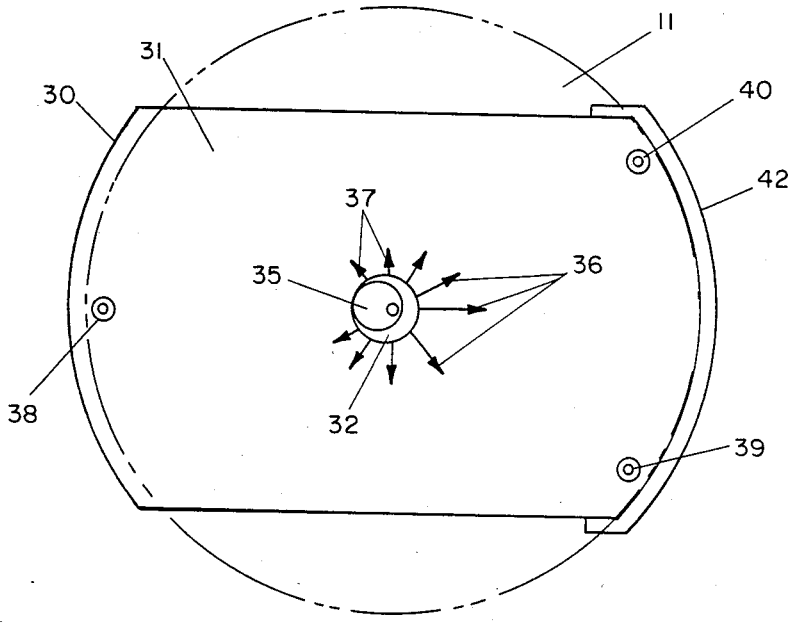

In accordance with an embodiment of the present invention, the wafer pickup technique first utilizes the Bernoulli effect to lift the wafer from a rest position, and then uses vacuum to hold onto the wafer once the Bernoulli effect pressurized fluid flow is turned off. Such a technique is achieved by means of the wafer pickup device 26 which is shown in more details in FIGS. 2A and 2B. The pickup device 26 comprises a plate-like member 30 of about 100 mils in thickness having a substantially planar pickup surface 31. An orifice 32 formed around a central solid portion 35 attached to the plate-like member 30 is formed in the pickup surface 31 in a substantial central portion thereof. The orifice 32 is connected to a source of pressurized fluid, e.g., air, via a coupling arrangement 33, 34. The crescent-shape of the orifice 32, as shown in FIG. 2B, is designed to bias the flow of pressurized fluid out of the orifice along a desired direction thereby moving the wafer along that direction. In other words, the orifice 32 is such that more pressurized fluid will flow along the directional arrows 36 than along the directional arrows 37.

Attached to the pickup device 26 are several tubular bodies 38, 39 and 40 extending away from the planar pickup surface 31. The tubular bodies 38–40 are preferably short, thin tubes having heights of the order of 15 to 30 mils. Thus, the combined height of the member 30 and the bodies 38–40 is of the order of less than 150 mils. The tubular bodies 38–40 are interconnected, as schematically illustrated by inner conduit 41, and are connected to either a source of pressurized fluid or a source of vacuum (not shown) via conduits within the device holder 27.

The operational steps of the wafer pickup technique in accordance with an embodiment of the invention will be described with reference to FIGS. 2A, 2B and 3. From a height of about 50 mils above the surface of the wafer 11, the pressurized fluid is turned ON so that both the Bernoulli orifice 32 and the tubular bodies 38, 39 and 40 have pressurized fluid flowing therethrough (see block 50 in FIG. 3). The Bernoulli flow biased to one end of the pickup device 26 (as illustrated by directional arrows 36) results in lifting the wafer 11 toward the surface 31 and locating it against a stop 42 at the one end of the device 26. The fluid blowing out of the tubular bodies 38, 39 and 40 prevents the wafer 11 from hitting the end portions of the bodies 38–40.

Figure 3:
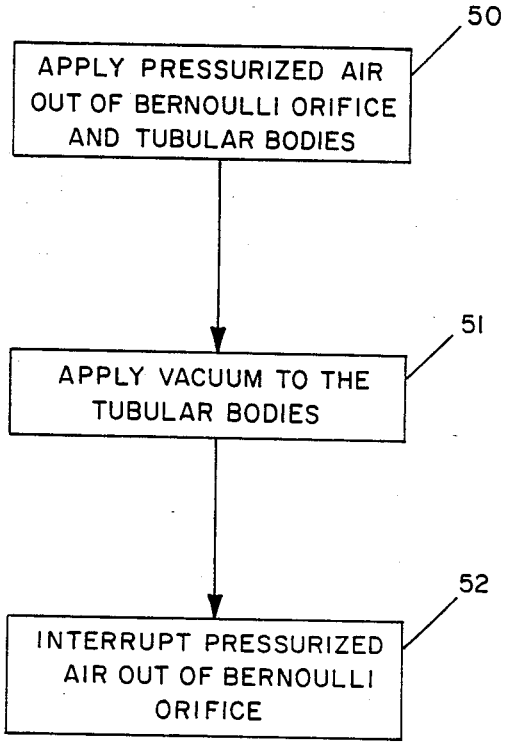
FIG. 3 is a flowchart of the various steps of a wafer pickup method in accordance with an embodiment of the invention.

Next, as illustrated by block 51 in FIG. 3, the tubular bodies 38, 39 and 40 are switched from the pressurized fluid mode to a vacuum mode. This causes the Bernoulli flow of pressurized fluid to increase resulting in further raising the wafer 11 in the direction of the pickup surface 31. The further movement of the wafer 11 in combination with the vacuum suction at the tubular bodies 38–40 puts the wafer 11 in a position where the tubular bodies 38–40 can grab it and hold onto it. Finally, the Bernoulli flow of pressurized fluid is interrupted (see block 52 in FIG. 3) or turned OFF. In such mode, the wafer 11 is held only by the vacuum applied via the tubular bodies 38–40 and is accurately positioned against the stop 42. The arc length of the stop 42 is preferably of the order of one fourth of the circumference of the wafer 11.

The advantage of the just-described pickup technique is that the device 26 is planar and can be inserted directly into a cassette between adjacent wafers thereof. Also, the device can pick up the wafer without the need of any external mechanisms and with minimum contact with the wafer. Furthermore, the high-velocity pressurized fluid stream needed for the Bernoulli effect is only turned ON for a relatively short period of time as opposed to conventional Bernoulli pickups. Moreover, the vacuum tubular bodies 38–40 are substantially smaller than they would be in conventional vacuum pickups since, according to the present invention, vacuum is not required to lift the wafer from a rest position.

It is to be understood that the embodiments described herein are merely illustrative of the principles of the invention. Various modifications may be made thereto by persons skilled in the art which will embody the principles of the invention and fall within the spirit and scope thereof.

What is claimed is:

1. A wafer pickup device for handling a semiconductor wafer comprising:

means for lifting and supporting the semiconductor wafer on a flow of pressurized fluid utilizing the Bernoulli effect; and means for gently contacting a plurality of predetermined portions of the wafer by means of a vacuum so that once the flow of pressurized fluid is interrupted, the wafer is held at its predetermined portion only by the vacuum.

2. A wafer pickup device according to claim 1, wherein the means for lifting and supporting comprise a centrally located orifice formed in a substantially planar pickup surface of the device.

3. A wafer pickup device according to claim 2, wherein the means for gently contacting comprise a plurality of short tubular bodies extending away from the planar pickup surface and located proximate to and within the outer boundaries of said pickup surface.

4. A wafer pickup device according to claim 3, comprising:

means for applying pressurized fluid through the tubular bodies; and means for applying vacuum to the tubular bodies thereby holding the wafer only at said peripheral portions thereof.

5. A wafer pickup device for handling semiconductor wafers comprising:

a substantially planar pickup surface having a substantially centrally located surface formed therein;

a plurality of tubular bodies extending away from said pickup surface and located proximate to and within the outer boundaries of said pickup surface to overlie the periphery of a wafer to be picked up;

first means coupled to said orifice and to said tubular bodies for selectively applying pressurized fluid therethrough for lifting the semiconductor wafer to be picked up toward and in spaced relationship to the pickup surface; and second means coupled to said tubular bodies for selectively applying vacuum therethrough thereby holding the semiconductor wafer at its periphery against the tubular bodies once the flow of pressurized fluid is interrupted.

6. A wafer pickup device according to claim 5, wherein said centrally located orifice is designed to lift and position the semiconductor wafer against a stop utilizing the Bernoulli effect.

7. A method for handling a semiconductor wafer by means of a pickup device comprising the steps of:

lifting and supporting, by means of a flow of pressurized fluid, a semiconductor wafer utilizing the Bernoulli effect;

gently contacting a plurality of predetermined portions of the wafer by applying vacuum to said predetermined portions; and interrupting the flow of the Bernouli effect pressurized fluid thereby holding the wafer only by means of the vacuum.

8. A method according to claim 7, wherein the lifting and supporting step comprises the steps of:

supplying a first flow of pressurized fluid directed toward a major surface of the wafer through a centrally located orifice formed in a pickup surface of the pickup device; and supplying a plurality of second flows of pressurized fluid directed toward the major surface of the wafer through the plurality of tubular bodies.

9. A method for handling a semiconductor wafer by means of a pickup device comprising the sequential steps of:

positioning a planar pickup surface of the pickup device proximate to a major surface of the wafer;

supplying a first flow of pressurized fluid through a centrally located orifice of the pickup surface toward said major surfaces for lifting the wafer utilizing the Bernoulli effect;

supplying a plurality of second flows of pressurized fluid directed toward the major surface of the wafer through a plurality of tubular bodies extending away from the pickup surface towards the wafer;

interrupting the second flows of pressurized fluid and applying vacuum to the tubular bodies thereby gently contacting peripheral portions of the major surface of the wafer; and interrupting the first flow of pressurized fluid thereby holding the wafer against the tubular bodies only by means of the vacuum applied thereto.

10. A method according to claim 9, further comprising the step of directionally biasing the first flow of pressurized fluid to located an edge portion of the wafer against a stop utilizing the Bernoulli effect while maintaining the supply of said second flows of pressurized fluid.

* * * * *